US007340072B2

(12) United States Patent
Schaub

(10) Patent No.: US 7,340,072 B2
(45) Date of Patent: Mar. 4, 2008

(54) SIGNAL PROCESSING IN A HEARING AID

(75) Inventor: Arthur Schaub, Wolfhausen (CH)

(73) Assignee: Bernafon AG, Bern (CH)

( * ) Notice: Subject to any disclaimer, the term of this patent is extended or adjusted under 35 U.S.C. 154(b) by 743 days.

(21) Appl. No.: 10/784,152

(22) Filed: Feb. 24, 2004

(65) Prior Publication Data

US 2004/0175011 A1 Sep. 9, 2004

(30) Foreign Application Priority Data

Feb. 26, 2003 (EP) ..... 03405125

(51) Int. Cl.
*H04R 25/00* (2006.01)

(52) U.S. Cl. ..... 381/312; 381/320; 381/316; 381/317; 381/94.1

(58) Field of Classification Search ..... 381/312, 381/316, 317, 318, 320, 94.1
See application file for complete search history.

(56) References Cited

U.S. PATENT DOCUMENTS 6,580,798 B1 6/2003 Schaub
2002/0057814 A1 5/2002 Kaulberg
2002/0094100 A1 7/2002 Kates et al.

*Primary Examiner*—Vivian Chin
*Assistant Examiner*—Con P. Tran
(74) *Attorney, Agent, or Firm*—Kenyon & Kenyon LLP

(57) ABSTRACT

In a method and a device for the signal processing in a hearing aid, in which coefficients of a filter for the frequency-dependent amplitude adaptation of an input signal are adapted in accordance with this input signal, the following steps are carried out:

Determining coefficients of a compression amplification $g_m$, which describe a frequency-dependent adaptation of the input signal in accordance with frequency-dependent signal levels of the input signal, determining coefficients of a noise suppression $a_m$, which describe a frequency-dependent adaptation of the input signal in accordance with interference noises detected in the input signal, and the calculation of the coefficients of the filter (6) $c_m$ out of the coefficients of the compression amplification $g_m$ and the coefficients $a_m$ of the noise suppression.

In this, only a single controllable filter is utilised both for the compression amplification as well as for the noise suppression, and a delay time for the filtering of the input signal is kept short.

20 Claims, 2 Drawing Sheets

SIGNAL PROCESSING IN A HEARING AID

The invention relates to a device and a method for the signal processing in a hearing aid in accordance with the preamble of the independent claims The invention is suitable in particular for the improvement of the language comprehensibility by the suppression of interfering noise in the case of hearing aids, resp., hearing devices.

STATE OF THE ART

A method in accordance with the field of the invention is known, for example, from EP 1 067 821 A1, the contents of which are herewith incorporated into this application by reference. In it an acoustic aid is described, in which the suppression of interfering noise takes place in a main signal path, which comprises neither a transformation in the frequency range nor a splitting-up into partial band signals, but solely comprises a suppression filter. A transmission function of the suppression filter is periodically determined anew on the basis of attenuation factors, which are established in a signal analysis path, which lies parallel to the main signal path. The attenuation factors are utilised for the attenuation of signal components in frequency bands having a significant proportion of interfering noise. The suppression filter is implemented as a transverse filter, the pulse response of which is periodically calculated anew as the weighted sum of the pulse responses of transverse band pass filters. In this manner, a processing with little signal delay is possible.

DESCRIPTION OF THE INVENTION

It is an object of the invention to create a device and a method for the signal processing in a hearing aid of the kind mentioned above, which implement a higher quality and comprehensibility of the processed signal.

This object is achieved by a device and a method for the signal processing in a hearing aid which adapt coefficients of a filter for the frequency-dependent amplitude adaptation of an input signal in accordance with the input signal; determine coefficients of compression amplification, which coefficients describe a frequency-dependent adaptation of the input signal in accordance frequency-dependent signals levels of the signal; and calculations of a noise suppression, which coefficients describe a frequency-dependent adaptation of the input signal in accordance with interference noises detected in the input signal and calculations establish these coefficients from the coefficients of the compression amplification and the coefficients of the noise suppression.

In the method according to the invention for the signal processing in a hearing aid

- coefficients of a compression amplification, which describe a frequency-dependent adaptation of the input signal in accordance with frequency-dependent signal levels of the input signal, are determined,
- coefficients of a noise suppression, which describe a frequency-dependent adaptation of the input signal in accordance with interfering noise detected in the input signal, are determined, and
- coefficients of a filter for the filtering of the input signal are calculated from the coefficients of the compression amplification and the coefficients of the noise suppression.

In this, with the term "adaptation of a signal" in summary both an amplification as well as an attenuation are meant.

By means of the invention it becomes possible to adapt the amplitude characteristic of the filter to changing voice signals and interference signals as well as to the requirements of a person with poor hearing, wherein a delay time for the filtering of the input signal is kept short.

A further advantage is that the compression amplification allows differing amplification values for different frequency ranges of the input signal.

A further advantage is the fact that only a single controllable filter is utilised both for the compression amplification as well as for the noise suppression.

In a preferred embodiment of the invention, determining the coefficients of the compression amplification takes place in a first number of frequency ranges $F_n$ with n=1 . . . N of the input signal on the basis of signal levels or amplitude components. A signal level is determined from a partial signal of the input signal, which is formed by filtering the input signal and splitting it up into partial signals with signal components respectively in only one frequency range. The signal levels are iteratively determined as momentary effective values of a signal power in the respective frequency ranges of the input signal. As a result, it becomes possible to adapt the compression amplification with a time-dependent resolution that corresponds to a sampling rate of the input signal.

In a preferred embodiment of the invention determining the coefficients $a_m$ of the noise suppression takes place in a second number of frequency ranges $\Phi_m$ with m=1 . . . M of the input signal by determining modulation depths $d_m$ and by determining the coefficients $a_m$ for each one of the frequency ranges $\Phi_m$ in accordance with the corresponding modulation depth $d_m$. In doing so, the modulation depths $d_m$ are determined from a time-dependent sequence of maximum-and minimum values of a signal level $p_m$ in the corresponding frequency range $\Phi_m$. As a result, it becomes possible to selectively filter out weakly modulated, this means monotonous interfering noises. Time constants for the adaptation of the noise suppression are preferably situated in the range of around 50 milliseconds or below.

In a preferred embodiment of the invention, the frequency ranges $\Phi_m$ for the noise suppression are small in comparison with the frequency ranges $F_n$ for the compression amplification. Therefore at least one frequency range $F_n$ comprises two or more frequency ranges $\Phi_m$. Correspondingly, filters for determining proportions of the input in the frequency ranges $\Phi_m$ comprise a greater signal run time or delay time than filters for the frequency ranges $F_n$. This makes possible a distinct split-up of the frequency range for the suppression of interferences and simultaneously a rapid adaptation of the compression amplification to a changing voice signal. A maximum delay which may be tolerated for the adaptation of coefficients of the compression amplification amounts to 5 milliseconds, preferable are values below 2.5 milliseconds. In accordance with the invention, values of below one millisecond are capable of being achieved.

In a further preferred embodiment of the invention, the filter is not exactly updated to the newly calculated coefficients in every sampling interval. Instead of this, it is only updated in accordance with one or several changed coefficients. This enables an adaptation with a small calculation effort and a correspondingly reduced energy consumption. Preferably the adaptation only takes place for that coefficient or those coefficients, the change of which exceed a predefined threshold or which is comparatively great or, respectively, the greatest. Also possible is a periodical changing of respectively one or of some few coefficients or a pseudo-random running through and adaptation of all coefficients.

In a further preferred embodiment of the invention, an influence of the noise suppression is taken into consideration in determining the coefficients for the compression amplification. For this purpose, a means for determining coefficients of the noise suppression transmits correction values to a means for determining coefficients of the compression amplification, which correction values correspond to a signal attenuation caused by the noise suppression.

The device according to the invention comprises the features of claim 10. A hearing aid in accordance with the invention comprises means for the implementation of the method according to the invention.

Further preferred embodiments follow from the dependent claims. In this, characteristics of the method claims are combinable analogously with the device claims and vice versa.

BRIEF DESCRIPTION OF THE DRAWINGS

In the following, the object of the invention is explained in more detail on the basis of preferred examples of embodiments, which are illustrated in the attached drawings. These depict.

The reference marks and their significance are listed in the list of reference marks in a summary form. In principle, identical components are referred to in the Figures with identical reference marks.

DESCRIPTION OF PREFERRED EMBODIMENTS

Figure 1:
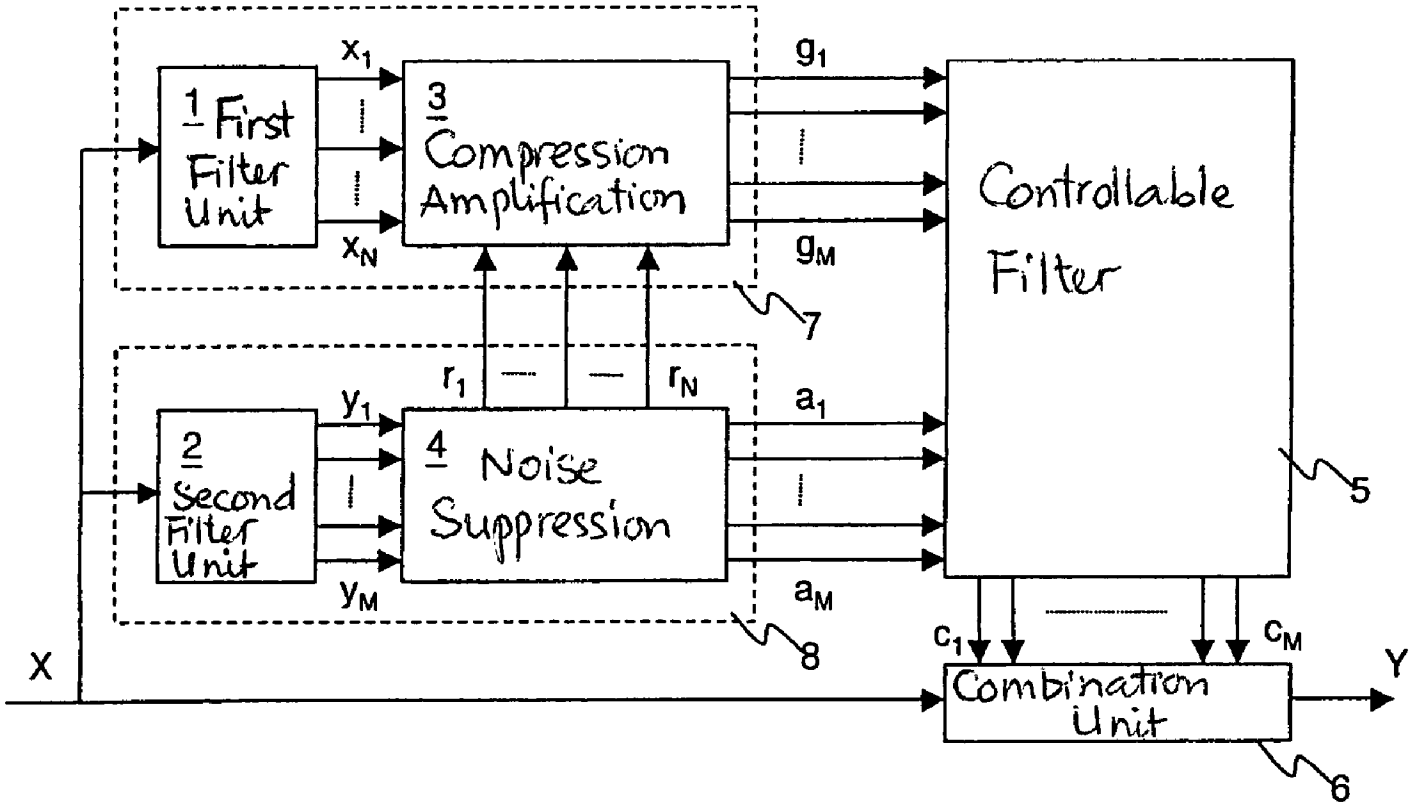
FIG. 1 schematically a structure of the signal processing.

FIG. 1 schematically illustrates a structure of the signal processing in a hearing aid according to the invention. An input signal X is brought to a controllable filter 6, to a means for the determination of a compression amplification 7 and to a means for the determination of a noise suppression 8. The controllable filter 6 is designed for the formation of an output signal Y in accordance with filter coefficients $c_1 \ldots c_M$.

In the means for the determination of the compression amplification 7, the input signal X is brought to a first filter unit 1. The first filter unit 1 is designed for the determination of signal proportions $x_1 \ldots x_N$ of the input signal X in a first number of frequency ranges $F_n$ with n=1 . . . N. In a signal processing for the compression amplification 3, from the signal proportions $x_1 \ldots x_N$ parameters, respectively, coefficients or adaptation values of the compression amplification $g_1 \ldots g_M$ are calculated. These coefficients, with a view to the amplification function of the hearing aid, are also designated as amplification values. Other coefficients, however, are also designated as amplification values.

In the means for the determination of the noise suppression 8 the input signal X is brought to a second filter unit 2. The second filter unit 2 is designed for the determination of signal proportions $y_1 \ldots y_M$ of the input signal X in a second number of frequency ranges $\Phi_m$ with m=1 . . . M. In a signal processing for the noise suppression 4, from the signal proportions $y_1 \ldots y_M$ parameters, respectively coefficients or adaptation values of the noise suppression $a_1 \ldots a_M$ are calculated. These coefficients with a view to the noise suppression achieved are also designated as attenuation values.

The combination unit 5 combines the coefficients of the compression amplification $g_1 \ldots g_M$ with the coefficients of the noise suppression $a_1 \ldots a_M$ and from this calculates combined logarithmic amplification values $c_1 \ldots c_M$ as filter coefficients of the controllable filter 6. Preferably, the mentioned coefficients $g_i$, $a_i$ and $c_i$ are logarithmically scaled and in the combination unit 5 essentially a subtraction $c_m = g_m - a_m$ with m=1 . . . M is carried out.

In a preferred embodiment of the invention the signal processing for the noise suppression 4 transmits correction values $r_1 \ldots r_N$ to the compression amplification 3, which correspond to a respective signal attenuation in the frequency ranges $F_1 \ldots F_n$ caused by the noise suppression.

In a further preferred embodiment of the invention, the first filter unit 1 and the second filter unit 2 are not implemented as separate units, but rather as a combined filter unit. For example, sequentially a filtering with wide frequency bands is carried out for the determination of the signal proportions $x_1 \ldots x_N$, and these filtered signals are further filtered for the determination of the signal proportions $y_1 \ldots y_M$.

The invention in the demonstrated embodiment in summary operates as follows: The input signal is split-up into three signal paths, a main signal path with a controllable filter, a first parallel signal analysis path for the compression amplification and a second parallel signal analysis path for the noise suppression.

Figure 2:
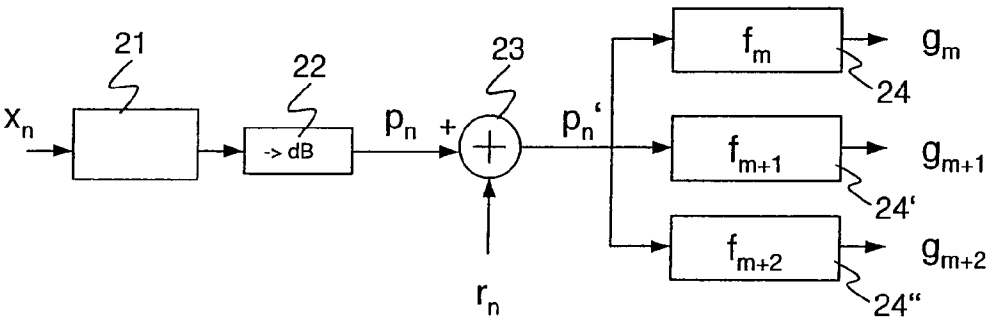
FIG. 2 a block diagram of a calculation of amplification values.

FIG. 2 depicts a block diagram of a calculation of amplification values in the signal processing for the compression amplification 3. For the compression amplification, signal levels are calculated in N relatively few frequency ranges. FIG. 2 illustrates the calculation for one of these N frequency ranges, for the remaining frequency ranges the same structure is utilised. From a signal proportion $x_n$ in this frequency range a signal power is formed in a block 21, for example, as a running total of squared signal values. In a block 22, by means of taking the logarithm, a signal level $p_n$ is formed. The term signal level here therefore designates the effective value of the momentary signal power in the frequency range $F_n$ expressed in a logarithmic range of numbers, e.g., in dB. From the signal level $p_n$ by subtraction 23 of a correction value $r_n$ a modified signal level $p_n'$ is calculated. The determination of correction values $r_n$ is separately dealt with further below. Assigned to every frequency range $F_n$ of the compression amplification is at least one frequency range $\Phi_m$ of the noise suppression. For each one of these assigned frequency ranges $\Phi_m$ (in FIG. 2 there are three, corresponding to blocks 24, 24', 24") a function $f_m$ of its own is predefined, which calculates from the modified signal level $p_n'$ an amplification value $g_m$, thus $$g_m = f_m(p_n').$$

These functions $f_m$ take into account an individual loss of hearing power and audiological experience. Parameters contained in the functions $f_m$, amplification values or hearing correction values are preferably user-specific and, for example are stored in an EPROM of the hearing aid. The total number of these functions $f_m$ and of the amplification values $g_m$, that is, over all N frequency ranges $F_n$ of the compression amplification, is equal to the number M of the frequency ranges $\Phi_m$ of the noise suppression.

If one is aiming for amplifying quiet phonemes, i.e., consonants, more than loud phonemes, i.e., vowels, in order that for a person with impaired hearing all phonemes in continuously spoken language become audible to an as great as possible extent, then the signal levels $p_n$ have to be determined in such a manner that differences between quiet and loud successive phonemes are well detected. In addition, the continuously determined amplification values $g_m$ have to be applied with the correct timing to those signal sections in which the accompanying phonemes are situated, i.e., the amplification values have to act on the audio signal X synchronously. A synchronous compression amplification acting with such a speed, in the rhythm of successive phonemes only provides good results, if the number of separate frequency ranges is selected to be small, e.g., $N \leqq 5$, preferably $N \leqq 3$. Otherwise spectral differences between the frequency ranges characteristic for the different phonemes are diminished too much and with this the speech comprehensibility is impaired. The compression amplification with few, relatively wide frequency bands is possible with a slight processing delay in the order of magnitude of 1 millisecond, which comes close to the requirement of an ideally delay-free signal processing. In a preferred embodiment of the invention, the compression amplification is carried out for only a single frequency band, that is, jointly for the entire frequency range of the audio signal. In another embodiment of the invention, two frequency bands are utilised for this, therefore N=2.

The signal analysis for the determination of signal levels in frequency ranges $f_n$ for the compression amplification is preferably carried out iteratively, wherein for every new value of the input signal current signal levels are determined. For this purpose, preferably recursive signal analysis methods are utilised. For example, the squared average value of the signal x[k] at the k-ed sampling point in time is calculated iteratively as $$s[k]=s[k-1]+\epsilon\cdot(x^2[k]-s[k-1]),$$

wherein $0<\epsilon<<1$ is selected.

A corresponding signal level value, e.g., in dB, then results as $$p[k]=10*\log 10(s[k]).$$

In case of the noise suppression, the objective is to diminish partial signals in frequency ranges of the audio signal, in which frequency ranges mainly only monotonic interfering noises are located. To do so, first of all in M separate frequency ranges $\Phi_m$ differences between maximum—and minimum values of the signal levels $p_m$ succeeding one another in time, so-called modulation depths $d_m$, are established, wherein m=1, . . . , M is applicable.

For the noise suppression, an iterative determination of the signal levels in Step with the sampling rate of the input signal is not necessary. In order to save calculation operations, one therefore preferably works with reduced sampling rates. In doing so, the signal level $p_m$ is formed in the corresponding frequency range $\Phi_m$ segmentwise for segments with a length of approx. 20-30 ms as the momentary effective value of the signal power. With this, it is possible keep the noise suppression updated with a resolution in time $p_m$ of, for example, less than 50 ms.

For the determination of maximum values and minimum values, separate estimated value functions are kept updated: For this purpose, in every scanning interval a stored maximum value is either linearly or in accordance with an exponential function reduced by a small increment, or else the current level value is taken over, providing it exceeds this reduced maximum value. In the same manner the minimum value in every sampling interval is increased by a small increment or else the current level value is taken over, providing it falls below the increased minimum value. The modulation depth therefore results as the difference between these two estimated value values. A small modulation depth therefore is produced in case of a signal energy which remains the same. In order to avoid sudden changes in the modulation depth, the difference values established in this manner are preferably additionally subjected to a smoothing. By means of a corresponding selection of the mentioned increments, the extremes decay with time constants in the range of some few seconds.

For speech in a quiet acoustic environment, the modulation depth assumes values of 30 dB and more. In traffic noise, the low frequency range up to around 500 Hz is frequently dominated by a monotonic interfering noise, so that even in case of the presence of speech signals the modulation depth in this frequency range declines to close to 0 dB. Other interfering noises again cover over the speech signal rather more in higher frequency ranges. Preferably partial signals in frequency ranges $\Phi_m$ are diminished, in which the modulation depth $d_m$ drops below a critical value of, e.g., 15 dB, wherein the extent of the attenuation $a_m$ monotonically and, for example, linearly increases with a modulation depth becoming smaller.

For an as accurate as possible recording and separation of frequency ranges with differing modulation depths, a large number of separate frequency ranges is advantageous, e.g., M=20. For the signal processing in so many narrow frequency bands perforce a long time delay in the order of magnitude of 10 ms results, which, however is still well compatible with a gradual attenuation and occasional increasing of the partial signals in these frequency ranges.

The amplification values $g_m$ of the compression amplification 3 and the attenuation values $a_m$ of the noise suppression 4 are combined for each frequency range and brought to the controllable filter 6 as control variables $c_m$ in the main signal path. The transmission function of the controllable filter when so required is updated in every sampling interval of the input signal, frequency-specific in one or in a few frequency ranges and left unchanged in all other frequency ranges.

For the combined application of compression amplification and noise suppression there is the possibility to carry out a signal analysis in relatively many frequency ranges $\Phi_m$, as it makes sense for the noise suppression, and to thereafter summarise the results in a suitable manner with respect to the few frequency ranges $F_n$ relevant for the noise suppression. The disadvantage of a sequential procedure of this kind consists of the fact, that for the overall signal processing a long signal delay in the order of magnitude of 10 ms results. From the point of few of the calculation effort, for an implementation of this type in particular the fast Fourier transformation and the inverse fast Fourier transformation would appear to be attractive. In doing so, the audio signal one after the other in individual segments with a duration of approx. 10 ms in the frequency range is transformed, analysed and modified, and subsequently transformed back into the time range. By the application of the segment by segment signal processing, however, the following disadvantages result: The signal levels $p_n$ are calculated as average values in a segment, as a result of which a distinctive signal increase at a certain point in time is only recorded with the time-dependent resolution of a processing segment. Also the determination of the individual amplification values and with this of the overall transmission function only takes place at the cadence of the successive segments.

Therefore, the filtering of the input signal X is preferably carried out on the basis of a separate and running in parallel signal analysis for the noise suppression as well as for the compression amplification. In doing so, the coefficients $a_m$ for the noise suppression, that are perforce received with a time delay, are combined with more rapidly received coefficients for the compression amplification $g_m$, and several of the coefficients $g_m$ with differing functions $f_m$ are determined on the base of the same, optionally modified signal level $p_n'=p_n-r_n$ of a frequency range $F_n$ for the compression amplification.

The combined and parallel processing takes place in detail as follows: In the lowest signal path the audio signal passes through a controllable filter 6, which carries out the necessary frequency-dependent signal modifications. The two upper signal paths each contain a filter unit, which filter units split-up the audio signal into partial signals of separate frequency ranges. The first filter unit 1 effects a signal split-up in only few frequency ranges $F_n$ with the width N, which can be implemented with an only slight signal delay. The second filter unit 2 effects a signal split-up into many frequency ranges $\Phi_m$ with a narrow width M, which entails a long delay time. In doing so, the frequency ranges are preferably selected in such a manner that every frequency range $\Phi_m$ is a partial range of a frequency range $F_n$. The frequency ranges for the compression amplification $F_n$ together preferably cover the same frequency range as the frequency range for the noise suppression $\Phi_m$- a frequency range for the compression amplification respectively covers several frequency ranges for the noise suppression. Ratios between the widths of frequency ranges and between the splitting-up of frequency ranges are preferably at least nearly logarithmic.

A typical frequency range for the input signal is: 0 to 10 kHz. This is, for example, split-up into the following frequency ranges for the compression amplification and the noise suppression:

| Compression amplification (Hz) | Noise suppression (Hz) |
|---|---|
| 0 to 1250 | 0 to 312.5 |
| | 312.5 to 625 |
| | 625 to 937.5 |
| | 937.5 to 1250 |
| 1250 to 2500 | 1250 to 1562.5 |
| | 1562.5 to 1875 |
| | 1875 to 2187.5 |
| | 2187.5 to 2500 |
| 2500 to 10000 | 2500 to 3125 |
| | 3125 to 3750 |
| | 3750 to 4375 |
| | 4375 to 5000 |
| | 50000 to 6250 |
| | 6250 to 7500 |
| | 7500 to 10000 |

In this, the sampling rate amounts to, for example, 20 kHz and correspondingly the useful band width to half of that, therefore 10 kHz. In another embodiment of the invention, these values amount to 16 kHz, respectively, 8 kHz.

In the signal analysis for the noise suppression, for every one of the M frequency ranges $\Phi_m$ a determination of the assigned signal level $p_m$, of the modulation depth $d_m$ and of the attenuation value $a_m$ takes place, wherein the latter is advantageously expressed in a logarithmic range of numbers. The determination of the modulation depth $d_m$ takes place as described above in accordance with, i.e., as a function of the time-dependent characteristic of the corresponding signal level $p_m$, and the determination of the coefficients $a_m$ in accordance with the corresponding modulation depths $d_m$. The second filter unit 2 and a part of the signal processing for the noise suppression 4 therefore form a means for determining these values $p_m$, $d_m$ and $a_m$ in a second number of frequency ranges of the input signal X.

In the signal analysis for the compression amplification, in each of the N frequency ranges $F_n$ the signal level $p_n$ is determined and this in such a manner that every signal value of the partial signal $x_n[k]$ contributes to an updating of the signal level, which leads to a higher time-dependent resolution than in the case of the sole determination of a segment by segment average value.

The first filter unit 1 and a part of the signal processing for the compression amplification 3 therefore form a means for the determination of signal levels in a first number of frequency ranges of the input signal X. Subsequently for all M frequency, ranges $\Phi_m$ amplification values $$g_m=f_m(p_n')$$

are determined, wherein every modified signal level $p_n'$, thus the levels reduced by the correction values $r_1 \ldots r_N$, is utilised for determining the amplification values in all those frequency ranges $\Phi_m$, which in combination result in the frequency range $F_n$. The correction values $r_n$ take into account a possible reduction of the signal powers as a result of the noise suppression.

Each one of the amplification values $g_m$ with m=1 . . . M is therefore assigned to a frequency range $\Phi_m$. With the determination of M different amplification values for the narrow frequency ranges $\Phi_m$ the compression amplification in the combined signal processing in accordance with the invention is capable of being implemented at the same time also with an essentially more flexible transmission function, therefore with M instead of only N functions $f_m$, than if solely one amplification value were to be determined for every wide frequency range $F_n$. The amplification values $g_m$ once again preferably are expressed in a logarithmic scale. The functions $f_m$ determine, frequency-specifically and in dependence of the signal level, a desired frequency-specific amplification in accordance with audiological principles.

The M amplification values and attenuation values reach the combination 5 of amplifications and attenuations, where they are separately combined in every frequency range $\Phi_m$, which in the case of the utilisation of a logarithmic range of numbers takes place by a simple subtraction:

$$c_m=g_m-a_m.$$

The M combined logarithmic amplification values $c_m$ reach the controllable filter 6, where they are transformed into linear amplification values $\gamma_m$. The controllable filter 6 with the transmission function H(z) can be assembled out of M parallel filters, the transmission functions $H_m(z)$ of which respectively only in the frequency range $\Phi_m$ possess a pass-through characteristic, and in all other frequency ranges have a blocking characteristic, and for the achievement of the desired frequency-dependent modification of the audio signal X are each respectively multiplied with the linear amplification value $\gamma_m$ $$H(z)=\gamma 1\cdot H1(z)+\gamma 2\cdot H2(z)+\ldots+\gamma M\cdot HM(z).$$

For an updating of the controllable filter 6 in step with the sampling rate of the audio signal X, this elementary relationship is not suitable, because the calculation effort and the power requirement of an integrated circuit associated with this would be much too great. It is solely suitable for a segment by segment updating, which, however, because of the reduced time-dependent resolution is not optimal in the embodiment illustrated here as an example.

In order to achieve better time-dependent resolution, the transmission function H(z) of the controllable filter 6 preferably is updated iteratively in every sampling interval k in accordance with $$H(z)[k]=H(z)[k-1]+\delta H(z)[k],$$

wherein the value δH(z)[k] represents the exact updating of the controllable filter 6 in one or perhaps some few frequency ranges $\Phi_m$. In the case of the updating in a single frequency range $\Phi_m$ therefore the following is applicable $$\delta H(z)[k]=(\gamma_m[k]-\gamma_m[\kappa_m])\cdot H_m(z),$$

wherein $\kappa_m$ designates the sampling interval in which the frequency range $\Phi_m$ has been updated the last time. Therefore in the predefined regular sampling intervals or, respectively, time intervals, preferably with the sampling rate of the input signal, not all, but solely selected coefficients are adapted, preferably exactly a single one.

For the selection of the frequency range or frequency ranges $\Phi_m$ to be updated at a certain sampling interval, in principle various possibilities exist. It is possible, e.g., to update respectively that frequency range $\Phi_m$, for which $|c_m[k]-c_m[\kappa_m]|$ is at a maximum, or those frequency ranges $\Phi_m$, in which these values exceed a certain threshold value, e.g., 1 dB. Another different possibility consists in the method that m simply time and again systematically or pseudo-randomly runs through all values from 1 to M.

In a preferred embodiment of the invention, by means of the correction values $r_1 \ldots r_n$ the following facts are taken into consideration: The noise suppression establishes attenuation values, which are only dependent on the modulation depths, not, however, on the signal levels themselves, as is correct for persons with a normal hearing. Persons with an impaired hearing, whose subjective perception of loudness, however, in general increases in a non-linear manner with the signal level, as a result will perceive a signal attenuation by a fixed value $a_m$ differently distinct, depending on the signal level. In a serial processing, therefore in the case of a noise suppression with an immediately following compression amplification, this effect would be automatically corrected. Because here, however a parallel processing is taking place, the correction values $r_1 \ldots r_n$ are transmitted from the noise suppression to the compression amplification, in order to implement this correction. Thus in the signal analysis for the noise suppression, attenuation-conditioned correction values $r_n$ are determined for the N signal levels of the compression amplification and the calculation of the amplification values takes place with signal levels, which are reduced by these correction values. Thus, the compression amplification is corrected in accordance with the noise suppression. With this it is achieved that the signals optimally processed, by means of the noise suppression, for the person of normal hearing are individually correctly reproduced in the hearing range of each and every person with an impaired hearing.

This specifically signifies, that for every frequency range $\Phi_m$ in addition to the already available signal power s[k] also a as a result of the frequency-specific noise suppression reduced signal power u[k] is calculated. For the frequency ranges $\Phi_m$ contained in a frequency range $F_n$, the s[k] and the u[k] are separately added. From the logarithmic ratio of the two sums the valid logarithmic correction value $r_n$ relative to $F_n$ is obtained.

Figure 3:
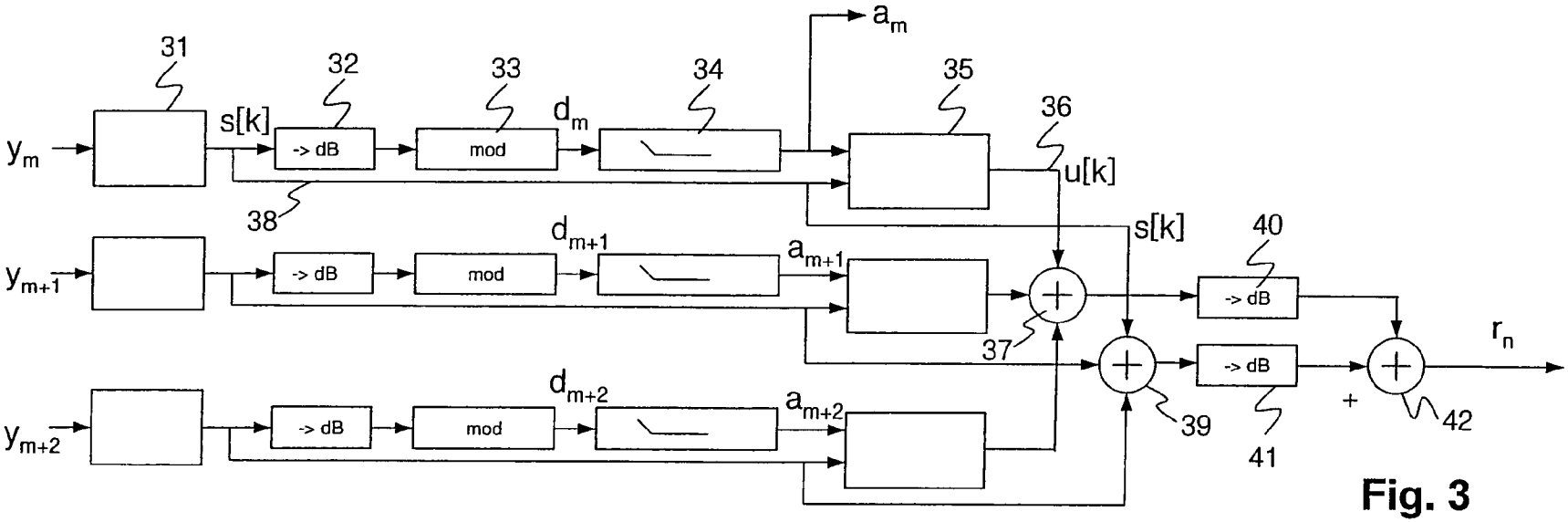
FIG. 3 a block diagram of a calculation of attenuation values and correction values in accordance with the invention.

FIG. 3 depicts a block diagram for a corresponding signal processing, as it takes place in the signal processing for the noise suppression 4 for determining the correction values $r_n$. A case is represented, in which three frequency ranges $\Phi_m$ of the noise suppression are contained in a frequency range of the compression amplification. In a block 31, in a known manner a signal power s[k] on the signal path 38 is determined and from it in block 32 a signal level, and from this in block 33 a modulation depth $d_m$ and from this in Block 34 an attenuation value $a_m$. In block 35, the logarithmic attenuation value $a_m$ is linearly scaled, and by multiplication with the signal power s[k] the reduced signal power u[k] on signal path 35 is calculated.

The reduced signal power u[k] is calculated for each one of the three frequency ranges, thus for $y_m$, $y_{m+1}$, $y_{m+2}$ in parallel and added together in node 37. The signal powers s[k] of the three frequency ranges are added together in the summation point 39. The totals are logarithmically scaled in the blocks 40, respectively, 41 and in the subtraction 42 the correction value $r_n$ is formed as a difference.

The device according to the invention preferably is at least partially implemented as an analogue circuit or based on a micro-processor or implemented with the utilisation of application-specific integrated circuits or with a combination of these techniques.

LIST OF DESIGNATIONS

| | |
|---|---|
| 1 | First filter unit |
| 2 | Second filter unit |
| 3 | Signal processing for the compression amplification |
| 4 | Signal processing for the noise suppression |
| 5 | Combination unit |
| 6 | Controllable filter |
| 7 | Means for determining a compression amplification |
| 8 | Means for determining a noise suppression |
| X | Input signal |
| Y | Output signal |
| 21 | Power formation |
| 22 | Level calculation, logarithmic scaling |
| 23 | Subtraction |
| 24, 24', 24" | Amplification function |
| 31 | Power formation |
| 32, 40, 41 | Level calculation, logarithmic scaling |
| 33 | Determination of modulation depth |
| 34 | Determination of attenuation value |
| 35 | Linear scaling |
| 36 | Reduces signal power u[k] |
| 37, 39 | Summation |
| 38 | Signal power s[k] |
| 42 | Subtraction |

The invention claimed is:

1. Device for the signal processing in a hearing aid, comprising a filter for the frequency-dependent amplitude adaptation of an input signal and means for the adaptation of coefficients of this filter in accordance with the input signal, wherein the device comprises a means for determining coefficients of a compression amplification $g_m$, which coefficients describe a frequency-dependent adaptation of the input signal in accordance with frequency-dependent signal levels $x_n$ of the input signal, a means for determining coefficients of a noise suppression $a_m$, which coefficients describe a frequency-dependent adaptation of the input signal in accordance with interference noises detected in the input signal, wherein the means for the adaptation of coefficients of the filter establishes these coefficients from the coefficients of the compression amplification $g_m$ and the coefficients of the noise suppression $a_m$.

2. Device in accordance with claim 1, wherein the means for determining coefficients of the compression amplification $g_m$ comprises a means for determining signal levels $p_n$ in a first number of frequency ranges $F_n$ with n=1. . . N of the input signal and a means for determining the coefficients $g_m$ for the compression amplification for each one of a second number of frequency ranges $\Phi_m$ with m=1 . . . M of the input signal as function of an optionally modified signal level $p_n$ assigned to the frequency range $\Phi_m$.

3. Device according to claim 2, wherein the means for determining signal levels $p_n$ forms these iteratively as momentary effective values of a signal power in the corresponding frequency range $F_n$.

4. Device in accordance with claim 1, wherein the means for determining coefficients of the noise suppression $a_m$ comprises means for determining modulation depths $d_m$ in a second number of frequency ranges $\Phi_m$ with m=1 . . . M of the input signal and a means for determining the coefficients $a_m$ for the noise suppression for each of the frequency ranges $\Phi_m$ of the input signal in accordance with the corresponding modulation depths $d_m$.

5. Device according to claim 2, wherein N<M applies and at least one of the frequency ranges $F_n$ for the compression amplification comprises at least two of the frequency ranges $\Phi_m$ for the noise suppression.

6. Device in accordance with claim 5, wherein the signal processing for the compression amplification is designed to determine each coefficient $g_m$ for the compression amplification respectively as $g_m=f_m(p_1)$, wherein $p_n$ is the optionally modified signal level of that frequency range $F_n$ for the compression amplification which comprises the frequency range $\Phi_m$ for the noise suppression, and $f_m$ is one of M functions, which in their totality determine a frequency-dependent compression amplification.

7. Device according to claim 6, wherein the coefficients $a_m$ und $g_m$ being combined with one another are logarithmically scaled and their combination by subtraction forms a combined logarithmic amplification value $c_m=g_m-a_m$.

8. Device in accordance with claim 1, wherein the means for the adaptation of coefficients of the filter is designed to adapt not all, but only selected coefficients at predefined time intervals.

9. Device in accordance with claim 1, comprising means for the correction of the compression amplification by modification of the signal levels $p_n$ in accordance with the noise suppression.

10. Method for the signal processing in a hearing aid, in which coefficients of a filter for the frequency-dependent amplitude adaptation of an input signal are adapted in accordance with this input signal, wherein the method comprises the following steps:

Determining coefficients of a compression amplification $g_m$, which describe a frequency-dependent adaptation of the input signal in accordance with frequency-dependent signal levels of the input signal, determining coefficients of a noise suppression $a_m$, which describe a frequency-dependent adaptation of the input signal in accordance with interfering noises detected in the input signal, and calculating the coefficients of the filter out of the coefficients of the compression amplification $g_m$ and the coefficients $a_m$ of the noise suppression.

11. Method according to claim 10, wherein for determining coefficients of the compression amplification $g_m$ in a first number of frequency ranges $F_n$ respectively assigned signal levels $p_n$ with n=1 . . . N of the input signal are determined, and the coefficients of the compression amplification $g_m$ for each one of a second number of frequency ranges $\Phi_m$ with m=1 . . . M of the input signal are determined as function of a signal level $p_n$ assigned to the frequency range $\Phi_m$.

12. Method in accordance with claim 11, wherein a signal level $p_n$ is iteratively calculated respectively as momentary effective value of a signal power in the corresponding frequency range $F_n$.

13. Method according to claim 10, wherein for determining coefficients of the noise suppression $a_m$ in a second number of frequency ranges $\Phi_m$ with m=1 . . . M of the input signal modulation depths $d_m$ are determined and the coefficients $a_m$ are determined for each one of the frequency ranges $\Phi_m$ in accordance with the corresponding modulation depth $d_m$, wherein the modulation depths $d_m$ are determined from a time-dependent sequence of maximum values and minimum values of a signal level $p_m$ in the respective frequency range $\Phi_m$, and the signal level $p_m$ is formed in a in a frequency range $\Phi_m$ as effective value of the signal power in the corresponding frequency range $\Phi_m$.

14. Method in accordance with claim 13, wherein for every modulation depth $d_m$, which exceeds a predefined value, the assigned coefficient $a_m$ is zero, and for values of the modulation depth $d_m$ below the predefined value, the coefficient $a_m$ increases monotonically with declining modulation depth $d_m$.

15. Method accordance with claim 10, wherein at least one of the frequency ranges $F_n$ for the compression amplification comprises at least two of the frequency ranges $\Phi_m$ for the noise suppression, and every coefficient $g_m$ for the compression amplification is determined respectively as $g_m=f_m(p_n)$, wherein $p_n$ is the signal level of that frequency range $F_n$for the compression amplification, which comprises the frequency range $\Phi_m$ for the noise suppression, and $f_m$ is one of M functions, which in their totality determine a frequency-independent compression amplification, and wherein the coefficients $a_m$ and $g_m$ are logarithmically scaled and their combination by subtraction forms a combined logarithmic amplification value $c_m=g_m-a_m$.

16. Method in accordance with claim 10, wherein the coefficients of the filter are updated at regular time intervals, wherein, however, during each updating not all, but only a few of the coefficients updated, in particular only those coefficients, the changes of which are the greatest or exceed a predefined value.

17. Method according to claim 16, wherein the combined coefficients of the filter (6) $c_m$ in the filter (6) are transformed into linear values $\gamma_m$ and an iterative, frequency-specific updating of a transmission function of the filter in accordance with $H(z)[k]=H(z)[k-1]+\Sigma_m\ (\gamma_m[k]-\gamma_m[\kappa_m])\cdot H_m(Z)$ takes place, wherein $H_m(Z)$ only in the frequency range $\Phi_m$ comprises a pass characteristic and otherwise a blocking characteristic, $\kappa_m$ designates a sampling interval, in which the transmission function for the frequency range $\Phi_m$ has been updated the last time, and a Summation $\Sigma_m$ in a sampling interval k respectively only comprises one or some few of the overall M frequency ranges.

18. Method in accordance with claim 10, wherein the step of determining coefficients of the compression amplification $g_m$ takes into consideration the values of the coefficients of the noise suppression $a_m$.

19. Method according to claim 18, wherein the coefficients of the compression amplification are determined from modified signal levels $p_n'$ instead of the signal levels $p_n$, wherein $p_n'=p_n-r_n$ applies, and $r_n$ are logarithmically scaled correction values, which correspond to a signal attenuation caused by the noise suppression.

20. A hearing aid, comprising means for the implementation of the method in accordance with claim 10.

* * * * *